US006276573B1

(12) United States Patent
Tofuku et al.

(10) Patent No.: US 6,276,573 B1
(45) Date of Patent: Aug. 21, 2001

(54) SLIDE GATE

(75) Inventors: Hiroyuki Tofuku, Suita; Shinjiro Saitoh, Hirakata; Kikuo Kametani, Osaka, all of (JP)

(73) Assignee: Sumitomo Heavy Industries Himatex Co., Ehime-ken (JP)

( * ) Notice: Subject to any disclaimer, the term of this patent is extended or adjusted under 35 U.S.C. 154(b) by 0 days.

(21) Appl. No.: 09/622,923

(22) PCT Filed: Feb. 25, 1999

(86) PCT No.: PCT/JP99/00910

§ 371 Date: Nov. 13, 2000

§ 102(e) Date: Nov. 13, 2000

(87) PCT Pub. No.: WO00/50188

PCT Pub. Date: Aug. 31, 2000

(51) Int. Cl.[7] ..... B22D 41/08
(52) U.S. Cl. ..... 222/600; 222/590
(58) Field of Search ..... 222/590, 591, 222/597, 600

(56) References Cited

U.S. PATENT DOCUMENTS 3,501,068 * 3/1970 Shapland ..... 222/600
3,587,945 * 6/1971 Lanatti et al. ..... 222/600
3,765,579 * 10/1973 Cramer et al. ..... 222/600

FOREIGN PATENT DOCUMENTS

08117985 * 5/1996 (JP) .

* cited by examiner

*Primary Examiner*—Scott Kastler
(74) *Attorney, Agent, or Firm*—Arent Fox Kintner Plotkin & Kahn

(57) ABSTRACT

A slide gate includes a frame fixed to a bottom of a molten-steel vessel, a guide frame attached to a bottom of the frame which can opened and closed, a plurality of refractory plates, a pair of surface-pressure bars and a cylinder. The plurality of refractory plates are disposed in a space surrounded by the frame and the guide frame with one of the refractory plates being slidable to control an amount of opening of a nozzle gate. The cylinder drives the slidable refractory plate to move a slide block with a protrusion. The protrusion moves a connecting member of the pair of surface-pressure bars so that the guide frame is connected with the frame and the slidable refractory plate is pressed to an immediate upper refractory plate by coil spring.

2 Claims, 12 Drawing Sheets

SLIDE GATE

FIELD OF THE INVENTION

The present invention relates to a slide gate to be mounted to the bottom of a molten-steel vessel such as a ladle or a tundish for pouring molten steel into the mold of a continuous casting device.

BACKGROUND OF THE INVENTION

It is generally known to fit the outlet of a molten-steel vessel with a slide gate and control the flow rate.

A slide gate consists mainly of a pair of refractory plates, which constitute a gate, and a mechanism to support and drive the refractory plates. One plate is moved to adjust the opening degree of the gate in order to control the flow rate of molten steel. It is necessary to effect the surface pressure between the refractory plates to prevent the static pressure of molten steel from causing the leak of molten steel from between the refractory plates. If the surface pressure is inadequate and molten steel leaks, it may lead to a serious accident.

The surface pressure between the refractory plates of an ordinary slide gates is several tenths of 1 MPa and, hence, the whole surface pressure is 2 to 10 tonf. On the other hand, because the refractories of the refractory plates are exposed to hot molten steel, they wear out rapidly. Accordingly, refractories are changed every several hours of casting. Changing refractories is troublesome: the surface pressure has to be lifted, the refractory plates have to be opened, the machine bolts and the cotters have to be removed to remove the refractories, new refractories have to be installed with the machine bolts and the cotters, and the surface pressure has to be effected again. If the surface pressure is too low, molten steel leaks from between the refractory plates. If the surface pressure is too high, the slide gate does not work due to too large sliding resistance and molten steel in the vessel cannot be poured in the mold. Therefore, it is very important to effect proper surface pressure between the refractory plates.

Accordingly, various surface-pressure application devices have been developed so far, for example, to prevent human errors or to prevent the difference in workmanship among individual workers from affecting the surface pressure. Representative devices are one to press coil springs with a linkage (Japanese Examined Utility Model publication No. 17497/S59 (1984)), one to press coil springs with bolts (Japanese Unexamined Patent publication No. 132432/S54 (1979)), and one to effect surface pressure with an actuator (Japanese Unexamined Patent publication No. 115965/H5 (1993) or 169213/H5 (1993)).

The above devices of the prior art are useful in their own ways, but not necessarily satisfactory.

In case of the device of the Japanese Examined Utility Model publication No. 17497/S59 (1984), the surface pressure can be effected just by turning a lever and, hence, the work can be made in a very short time. However, when it is adopted for a large-size slide gate which requires a surface pressure as large as several to ten odd tonf, the turning torque of the lever becomes as high as several hundred Nm. If the lever is short, a single worker cannot turn it. If it is long enough for a single worker to turn it, a large space has to be secured around it. Besides, when the surface pressure is lifted, the energy accumulated in the coil springs is released at a stroke, causing a large shock, which is unpleasant to the worker and can be dangerous.

In case of the device of the Japanese Unexamined Patent publication No. 132432/S54 (1979), by using power tools, the working time and the working space required can be reduced and labor can be saved. However, power tools are costly, they require a power source, and their noise affects the working environment. If a power source is not available, the bolts can be loosened and tightened with spanners, which however takes a long time.

In case of the devices of the Japanese Unexamined Patent publication Nos. 115965/H5 (1993) and 169213/H5 (1993), the surface pressure can be effected and lifted just by operating a valve for switching the actuator. Therefore, the pressure-effecting and lifting work itself is simple and can be made in a very short time. Besides, the valve operation can be automatized. However, since such an actuator and a valve, and a power unit for the actuator are necessary, the whole device becomes costly.

If cotters are used for installing refractories, some of them may loosen while the slide gate is in service. Machine bolts do not get loose, but threads may seize up, posing a problem to the change of refractories.

SUMMARY OF THE INVENTION

According to the first aspect of the present invention, there is provided a slide gate comprising a frame fixed to the bottom of a molten-steel vessel, a guide frame attached to the bottom of the frame so as to be openable and closable, and a plurality of refractory plates in the space surrounded by the frame and the guide frame. One of the refractory plates is slidable to control the opening degree of a nozzle gate. The frame has, on each side, a spring receiver extending in the sliding direction of said slidable refractory plate. A spring case, in which coil springs are set, is mounted on each spring receiver. Each spring case has, at each end, a pair of roller arms which extend to below the spring receiver and support a roller. A pair of surface-pressure bars is so provided that, when said guide frame is closed, each surface-pressure bar takes a position facing a spring case across the spring receiver and is movable under the guidance by the guide frame. A cylinder for driving the slidable refractory plate is utilized to move a slide block with a protrusion, and the protrusion moves a connecting member of the pair of surface-pressure bars so that the guide frame is connected with the frame and also the slidable refractory plate is pressed to the immediately upper refractory plate by the coil springs.

According to the second aspect of the present invention, there is provided a slide gate wherein each refractory plate is mounted and removed by using a wedge mechanism with a tapered member and a bolt and turning the bolt.

BRIEF DESCRIPTION OF THE DRAWINGS

The features and advantages of the present invention will become more clearly appreciated from the following description in conjunction with the accompanying drawings, in which.

DETAILED DESCRIPTION OF THE INVENTION

Figure 1:
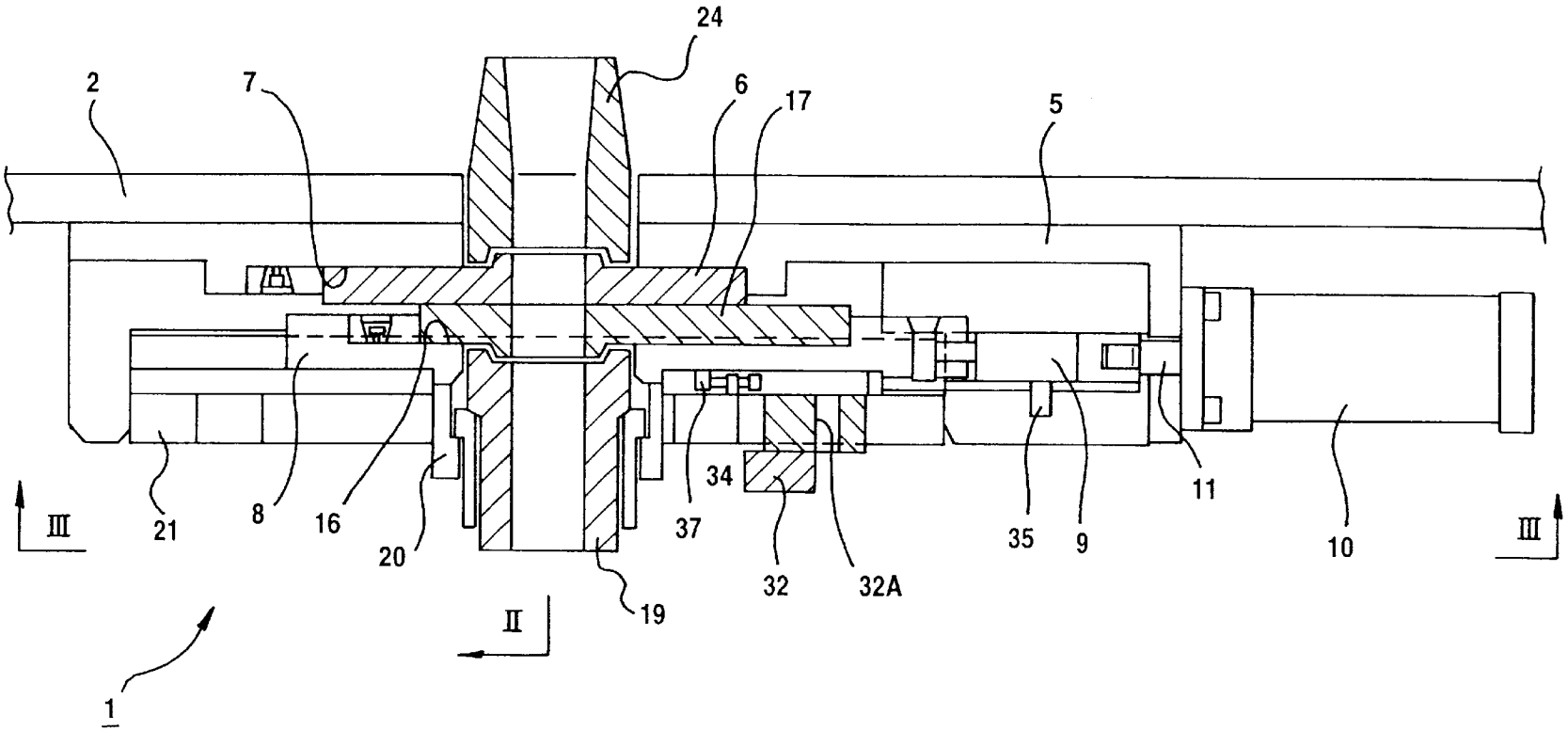
FIG. 1 is a longitudinal sectional view of a slide gate of the present invention.
Figure 2:
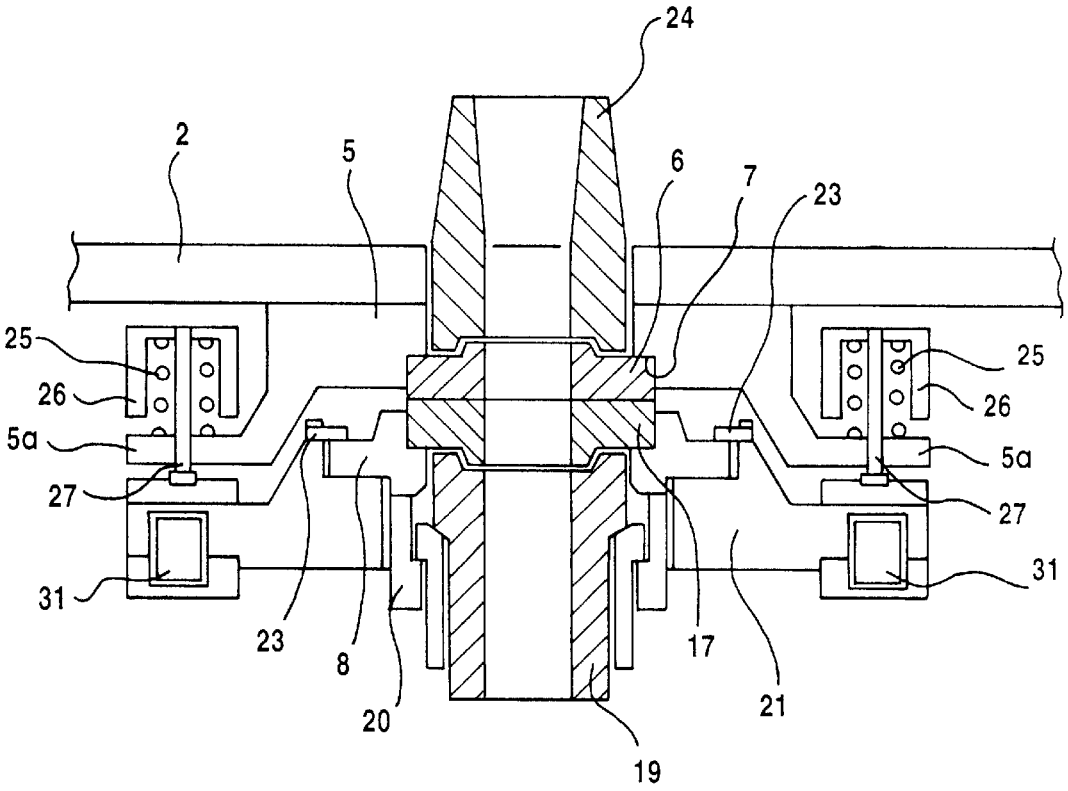
FIG. 2 is a sectional view taken along the line II of FIG. 1.

Referring now to the drawings, a preferred embodiment of the present invention will be described. FIGS. 1 to 7 show a slide gate 1 constructed in accordance with the present invention. The slide gate 1 has a frame 5 which is fixed to the bottom of a molten-steel vessel 2 by supports 4 and bolts 3. The frame 5 has a recess 7 to receive an upper plate 6. Fixed to one end of the frame 5 is a cylinder 10 which drives a moving frame 8 through a slide block 9. The cylinder 10 has a cylinder rod 11, which has a T-shaped head 12 at its outer end. The slide block 9 has a T-shaped groove 13, which engages the T-shaped head 12 by receiving it within. Thus, the slide block 9 is connected to the cylinder 10. On the other hand, a T-shaped coupler head 14 is provided on a side of the slide block 9, said side facing the moving frame 8. The moving frame 8 has a T-shaped groove 15, which engages the T-shaped coupler head 14 by receiving it within. Thus, the moving frame 8 is connected to the slide block 9, and hence the moving frame 8 is connected to the cylinder 10 through the slide block 9. The cylinder 10 reciprocates the slide block 9 along guide grooves formed by the frame 5 and guide plates 16.

A recess 18 is formed in the top of the moving frame 8 to receive a slide plate 17, and a lower-nozzle holder 20 is provided at the bottom of the moving frame 8 to hold a lower nozzle 19.

A guide frame 21 is attached to the frame 5 by pins 22 so that it can be opened and closed by turning it about the pins 22, and the guide frame 21 and the moving frame 8 are so configured that they can be opened and closed as a unit by turning them about the pins 22. Sliding-surfaces are formed on the top of the guide frame 21, and the moving frame 8 is placed on the sliding-surfaces so as to be slidable. The numeral 23 indicates moving-frame guides provided on the guide frame 21 and protruding toward the moving frame 8, and the numeral 24 is an upper nozzle.

Now a surface-pressure application device will be described.

Figure 5:
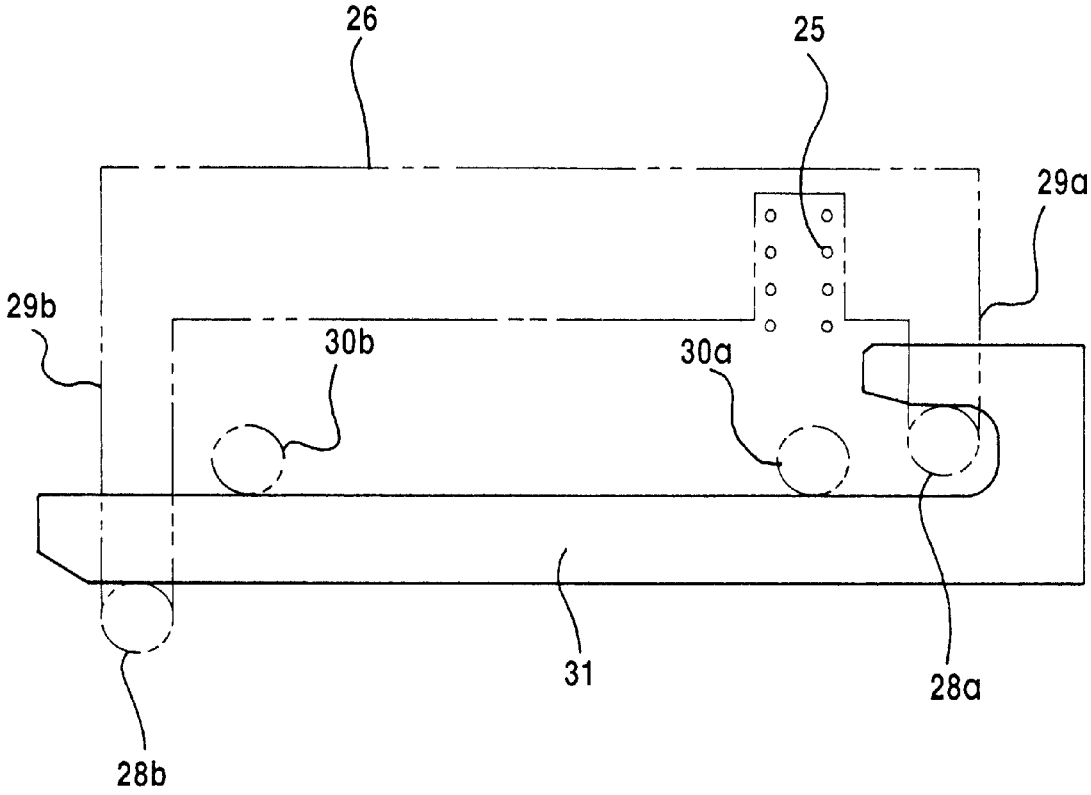
FIG. 5 is a side view of a surface-pressure bar 31 and a spring case 26 of FIG. 4.

The surface-pressure application device consists of two units. One unit is mounted on one side of the frame 5; the other unit, on the other side. The frame 5 has a spring receiver 5*a* on each side. A spring case 26, wherein coil springs 25 are set, is mounted on each spring receiver 5*a* by means of pre-loading bolts 27. As shown in FIG. 5, each spring case 26 is provided at one end with a pair of roller arms 29*a* supporting a roller 28*a* and at the other end with a pair of roller arms 29*b* supporting a roller 28*b*.

Figure 3:
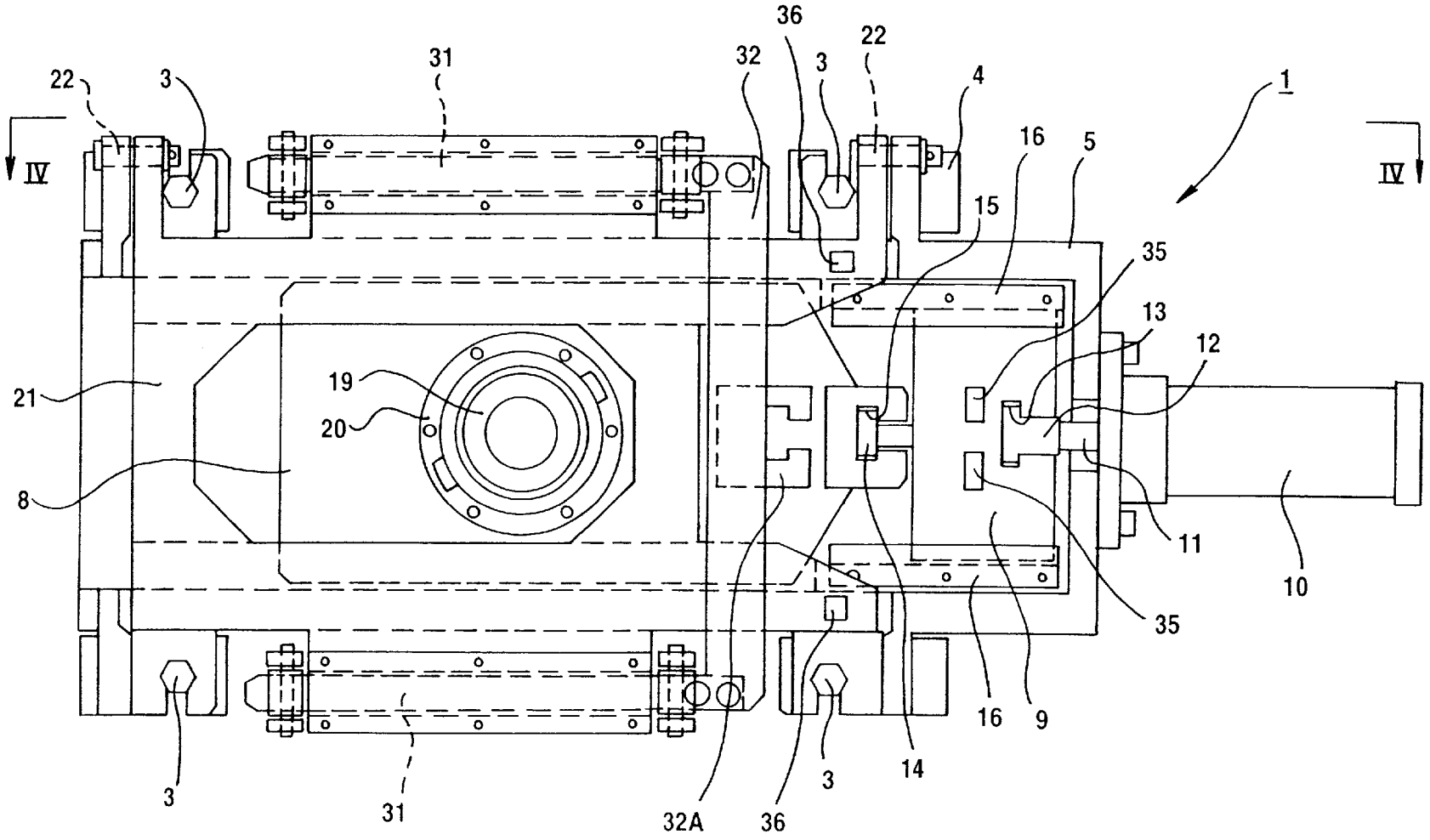
FIG. 3 is a bottom view taken along the arrowed line III—III of FIG. 1, the surface pressure being effected.
Figure 4:
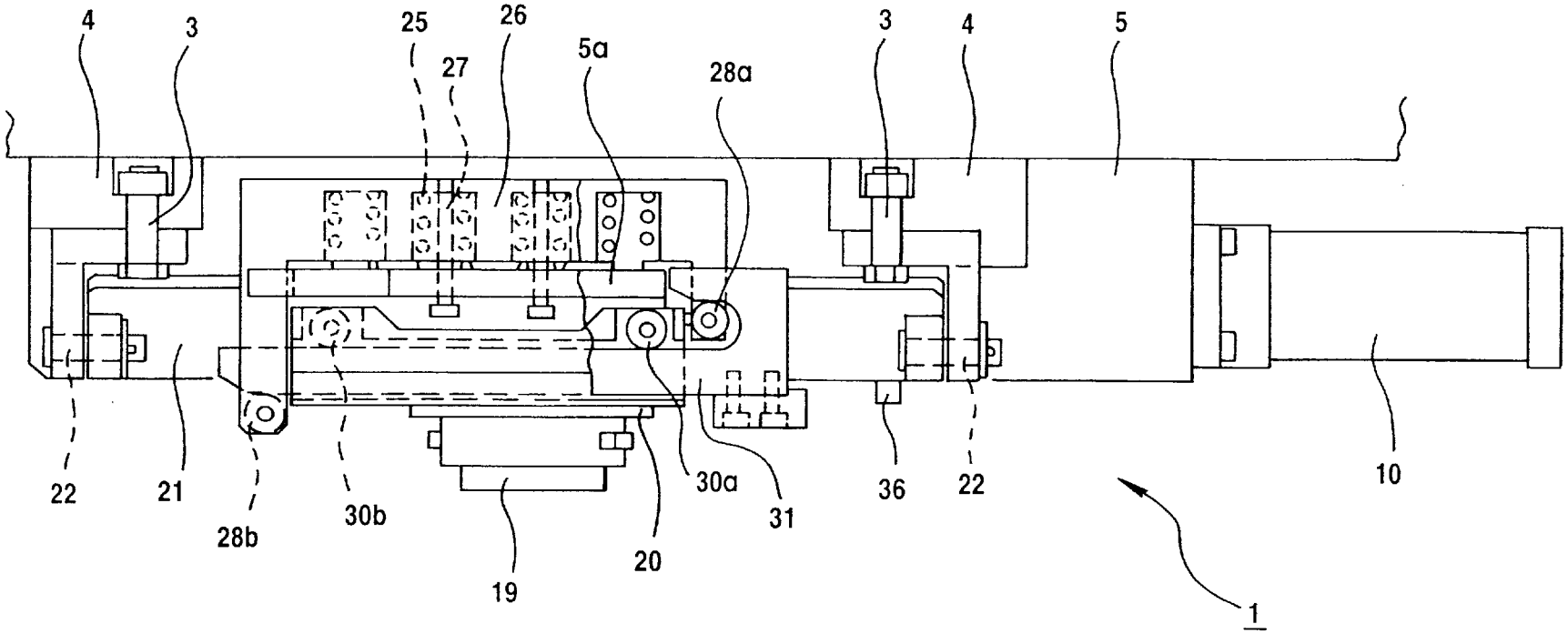
FIG. 4 is a side view taken along the arrowed line IV—IV of FIG. 3.
Figure 6A:
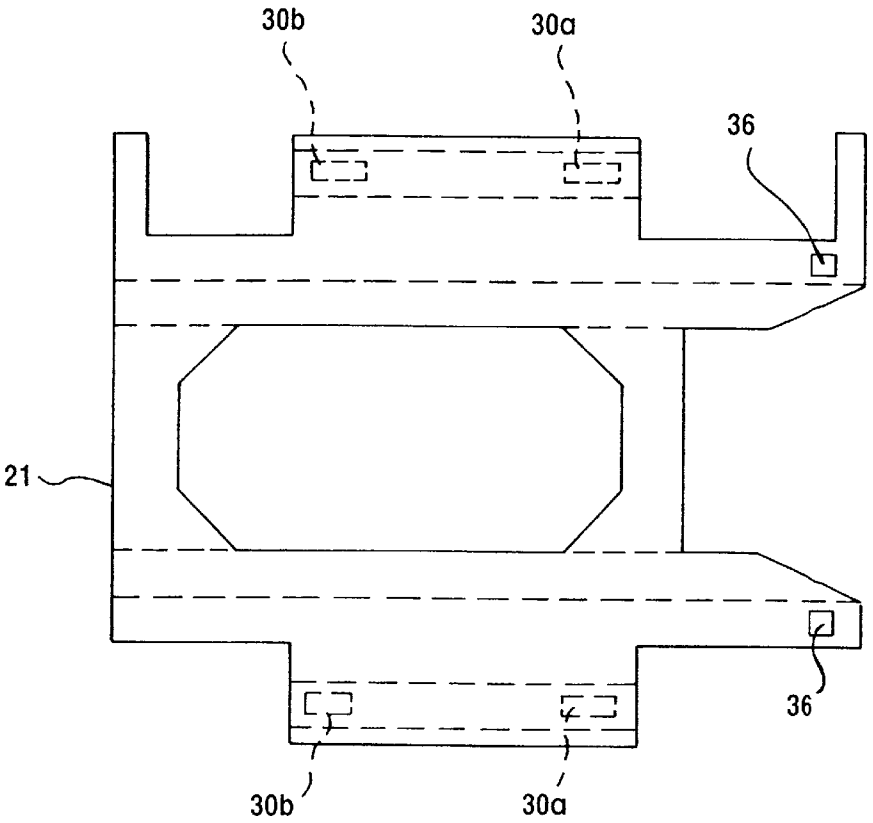
FIGS. 6(A) and 6(B) are a plan view and a side view, respectively, of the guide frame 21 of FIG. 3.
Figure 6B:
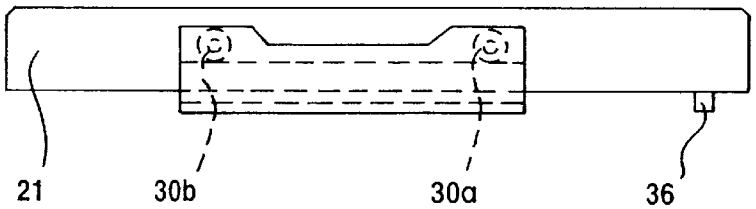

A roller 30*a* and a roller 30*b* are provided on each side of the guide frame 21 as shown in FIG. 6, and provided on each side of the guide frame 21 is a surface-pressure bar 31, in the shape a hook as seen from one side, which moves under the guidance by the rollers 30*a* and 30*b* as shown in FIGS. 3 and 5.

As shown in FIG. 3, the ends of the paired surface-pressure bars 31, on the side of the cylinder 10, are connected to each other by a connecting member 32, those bars and member forming the shape of an upside-down "U" in FIG. 3. A block with a T-shaped groove 32A is fixed to the middle of the connecting member 32.

Figure 7:
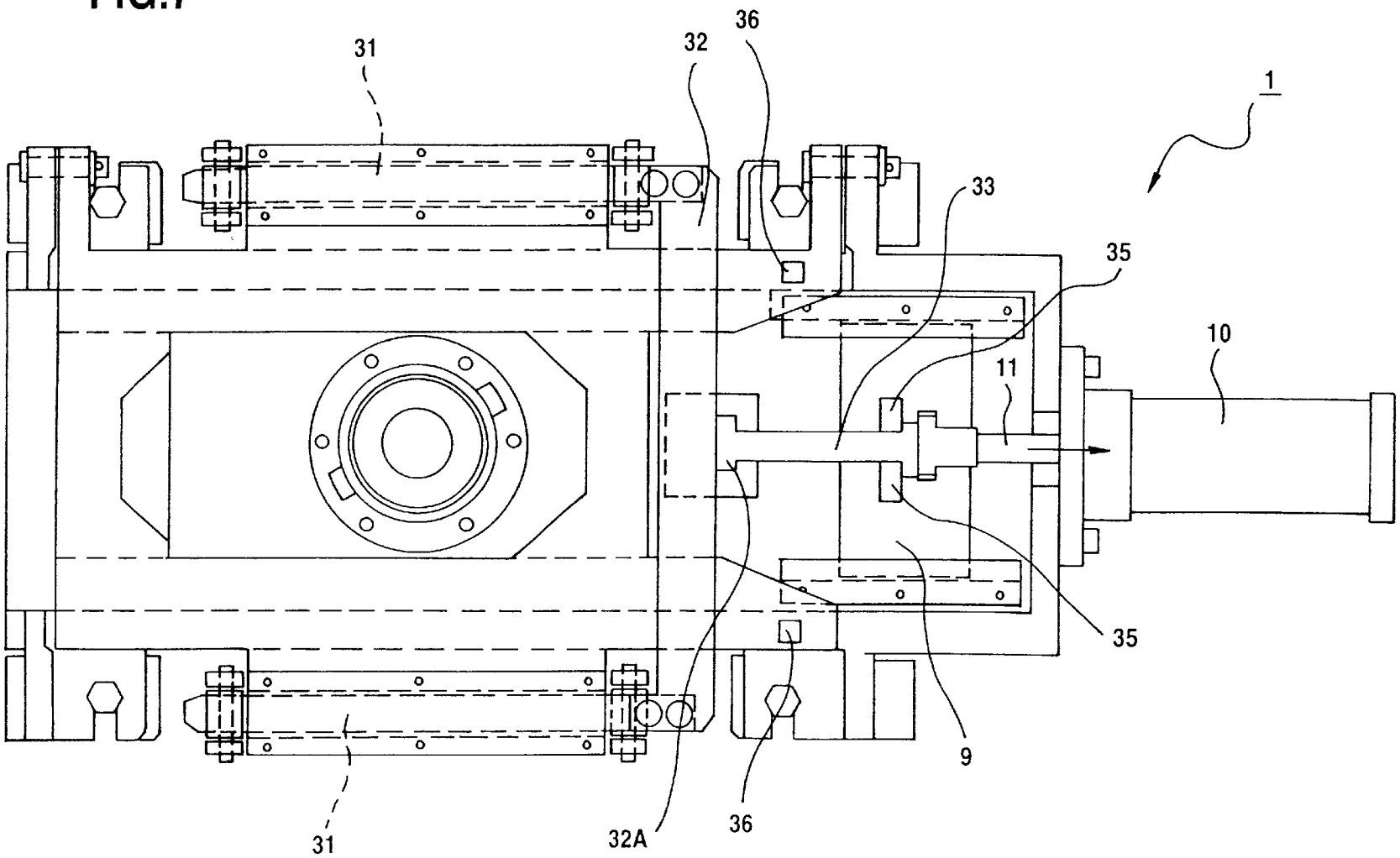
FIG. 7 is a bottom view taken along the arrowed line III—III of FIG. 1, the surface pressure being lifted.

As shown in FIG. 3, provided on the bottom of the slide block 9 are two protrusions 35 which are positioned to face the block with a T-shaped groove 32A. By moving the slide block 9 with the cylinder 10, the position of the moving frame 8 and the slide plate 17 is adjusted and the force of the extending cylinder 10 is transmitted to the surface-pressure bars 31 through the connecting member 32 to actuate the surface-pressure application device. One end of a release jig 33 shown in FIG. 7 is set in the groove of the block 32A and the other end is set between the protrusions 35. Then, the cylinder 10 is contracted to disable the surface-pressure application device. The numeral 36 indicates stoppers to prevent the surface-pressure bars 31 from being pulled out. The numeral 37 is a stopper to position the moving frame 8 (see FIG. 1).

Surface pressure between the upper plate 6 and the slide plate 17 is effected and lifted as follows.

FIGS. 1 to 4 show the state of the surface pressure effected, that is, of normal casting. The surface-pressure bars 31 are pulled up toward the spring cases 26. Therefore, the surface-pressure bars 31 are in a stationary state regardless of the extension and contraction of the cylinder 10 and hence the movement of the slide block 9.

The surface pressure is lifted as follows.

Figure 8:
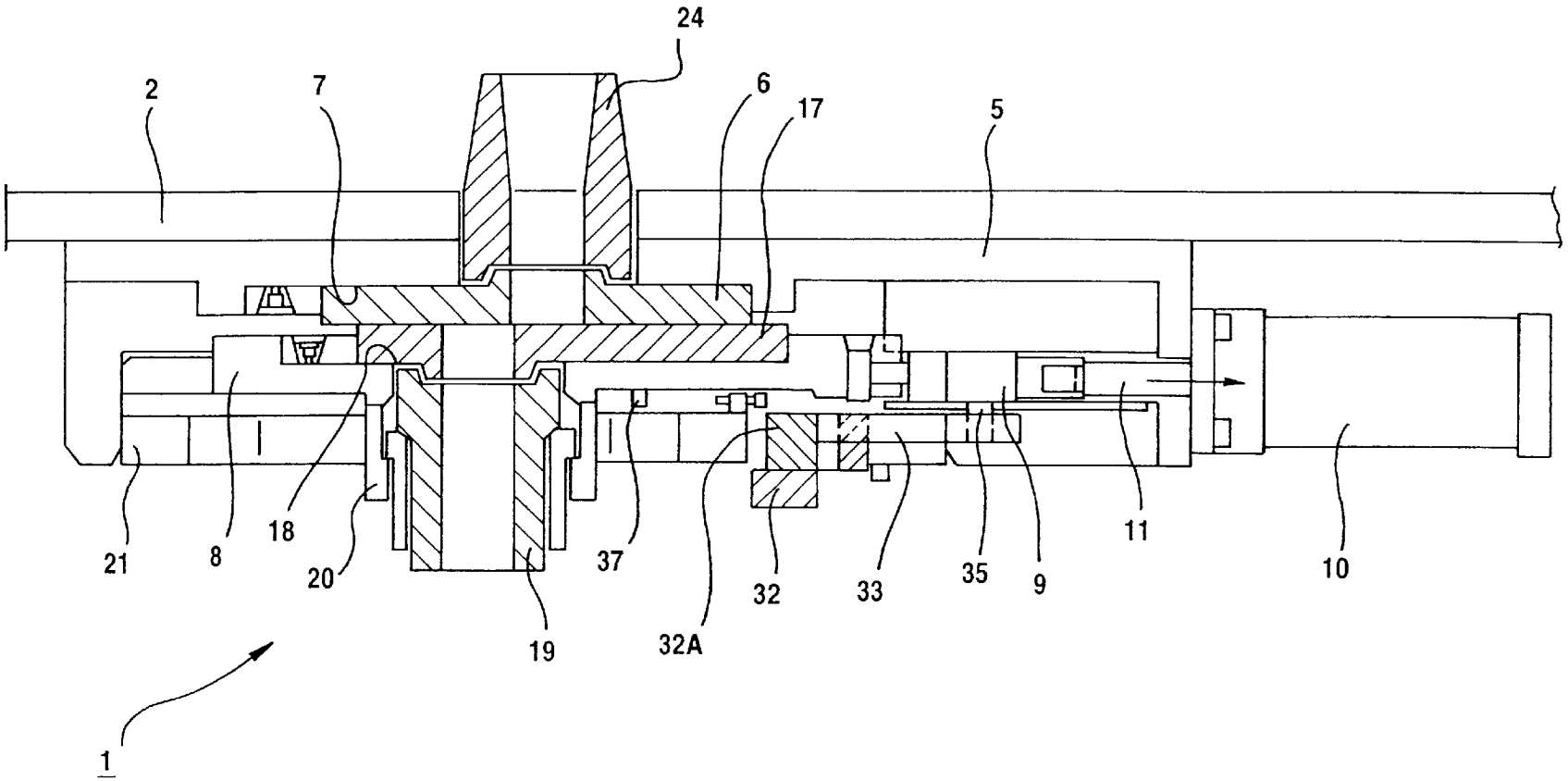
FIG. 8 is a sectional view of the slide gate of FIG. 1 to explain the method of lifting the surface pressure.

As shown in FIGS. 7 and 8, the cylinder 10 is operated to withdraw the cylinder rod 11 almost fully, namely, to position the slide plate 17 near its closing limit. The block with a T-shaped groove 32A of the connecting member 32 and the protrusions 35 of the slide block 9 are connected to each other by the release jig 33. Then, the cylinder 10 is operated to withdraw the cylinder rod 11. Accordingly, the connected member 32 and hence the hook-shaped surface-pressure bars 31 are moved toward the cylinder 10, i.e., the surface-pressure bars 31 being pulled out, and hence the surface-pressure bars 31 are disengaged from the rollers 28*a* and 28*b* and released from the pulling-up force of the coil springs 25. Thus, the surface pressure between the upper plate 6 and the slide plate 17 is lifted. Therefore, the guide frame 21 substantially fixed to the frame 5 through the surface-pressure bars 31 and the roller arms 29*a* and 29*b* is separated from the frame 5. Thus, now the guide frame 21 and the moving frame 8 can be opened by turning them about the pins 22. The release jig 33 is removed before opening them.

To change the refactories of the factory plates, or the upper plate 6 and the slide plate 17, the molten-steel vessel 2 is laid on its side, its bottom taking a vertical posture, When the guide frame 21 is turned open about the pins 22, the moving frame 8 will move downward under its self-weight. However, because the stopper 37, which is disposed slightly behind the limit to which the moving frame 8 can be moved by the cylinder 10, stops the moving frame 8.

On the other hand, the stoppers 36 on the guide frame 21 stop the surface-pressure bars 31 to prevent them from falling. Accordingly, after opening the guide frame 21, the refractories can be changed in the same way as those of the conventional slide gate.

The surface pressure between the upper plate 6 and the slide plate 17 is effected as follows.

Figure 9:
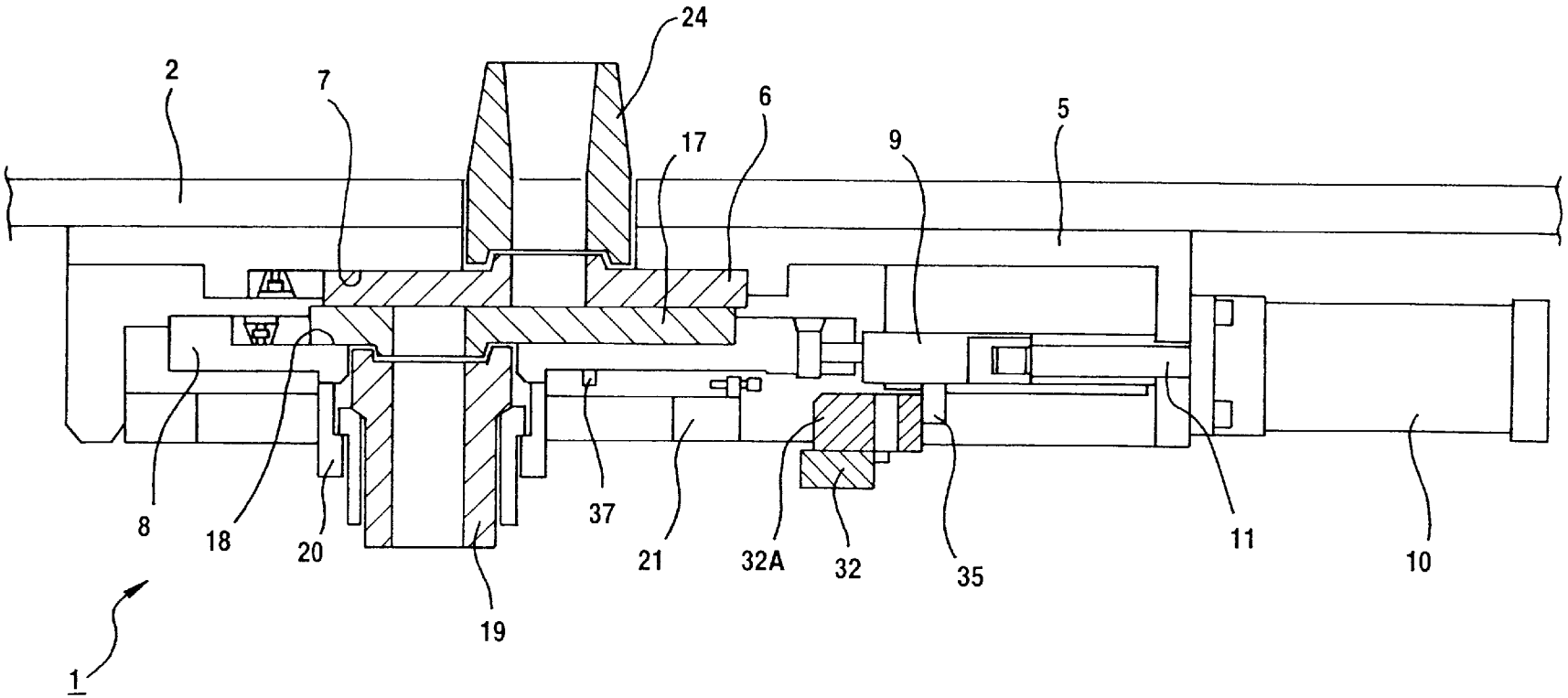
FIG. 9 is a sectional view of the slide gate of FIG. 1 to explain the method of effecting the surface pressure.

After changing the refractories, the guide frame 21 is turned shut about the pins 22. Then, as shown in FIG. 9, the cylinder rod 11 is protruded to move the slide plate 17 in the closing direction. Accordingly, the protrusions 35 of the slide block 9 push the connecting member 32 through the block with a T-shaped groove 32A to advance the surface-pressure bars 31 to the left in FIG. 9. Thus, the surface-preasure bars 31 ride on the rollers 28*a* and 28*b*, and the coil springs 25 exert upward force to push up the surface-preasure bars 31 therough the spring cases 26, the roller arms 29*a* and 29*b*, and the rollers 28*a* and 28*b* to effect the surface preasure between the upper plate 6 and and the slide bar 17.

In the above embodiment, the cylinder side of the slide gate comes down when the molten steel vessel 2 is laid on its side, its bottom taking a vertical posture. However, in case that the cylinder side of the slide gate comes up when the molten-steel vessel 2 is laid on its side, the stopper 37 and the stoppers 36 are disposed on the side opposite to the cylinder side to prevent the moving frame 8 and the surface-pressure bars 31 from falling, respectively.

Now, wedge mechanisms to fix the refractory plates 6 and 17, will be described.

Figure 10:
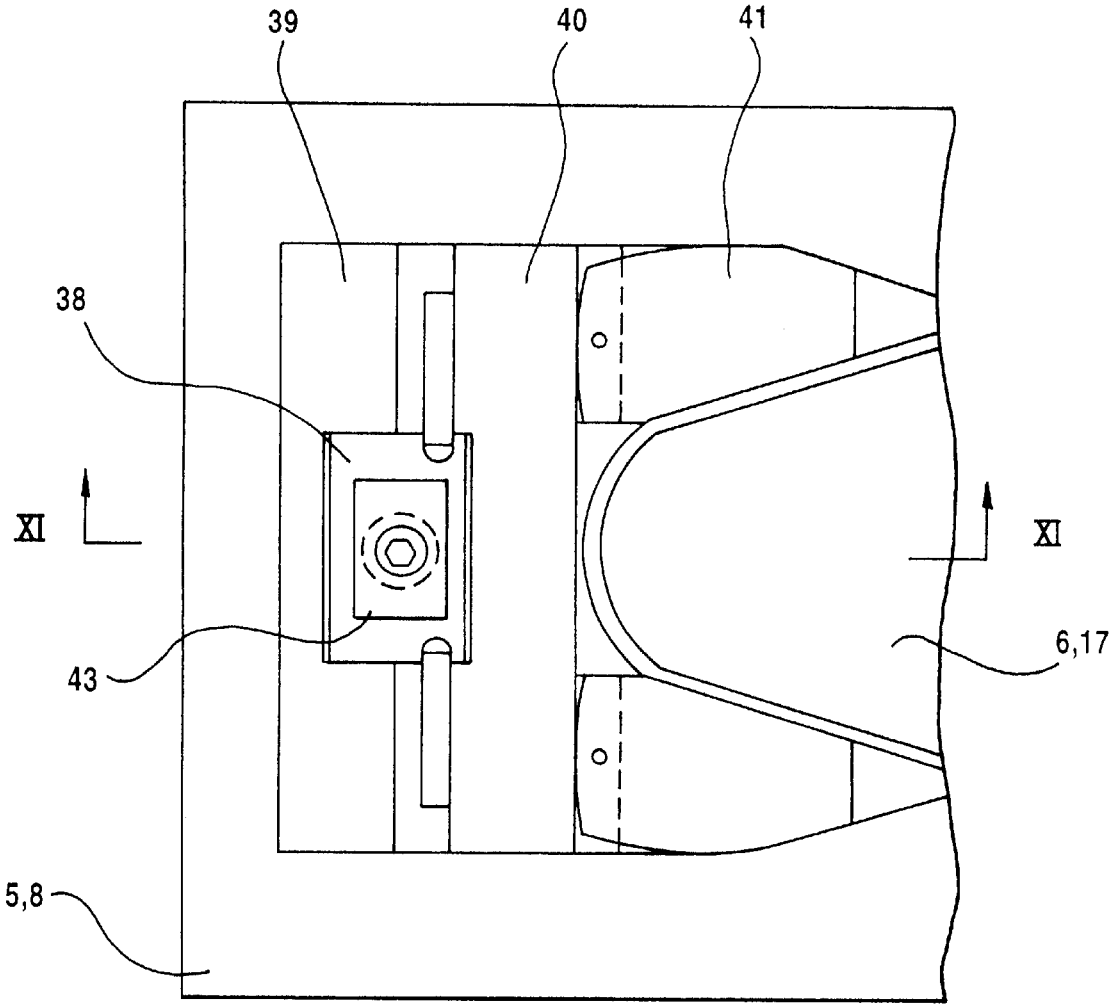
FIG. 10 is a plan view of a wedge mechanism of the present invention.
Figure 11:
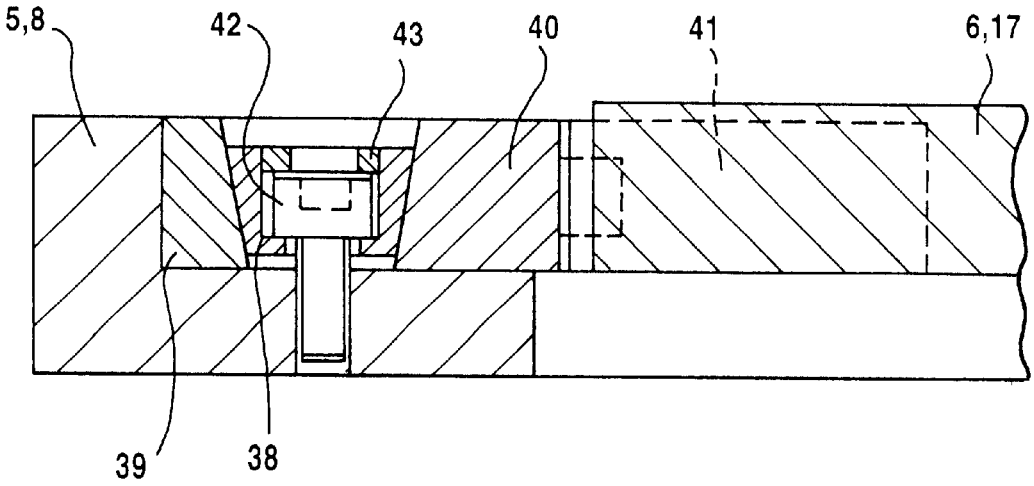
FIG. 11 is a sectional view taken along the arrowed line XI—XI of FIG. 10.

As shown in FIGS. 10 and 11, each wedge mechanism comprises a wedge block 38, a stationary block 39, a movable block 40, an adjusting bolt 42, and a wedge cover 43. Each of the refractory plates 6 and 17 is fixed by the wedge mechanism and plate dampers 41 which are connected to the movable block 40 by pins. The wedge block 38 is in the shape of a wedge. The stationary block 39 has a recess in the side facing the movable block 40, and the latter has a recess in the side facing the former, the two recesses forming a wedge-shaped space, wherein the wedgeblock38isput. Asshown in FIG. 1, in case of the upper plate 6, the wedge block 38 is driven toward the molten-steel vessel 2 by turning the adjusting bolt 42 in the tightening direction. The wedge block 38 drives the movable block 40 and hence the plate dampers 41 toward the cylinder 10 to fix the upper plate 6. In case of the slide plate 17, the wedge block 38 is driven in the opposite direction, leaving the molten-steel vessel 2 behind, and the plate 17 is fixed otherwise in the same way as the upper plate 6.

To remove the upper plate 6 or the slide plate 17, the adjusting bolt 42 is turned in the loosening direction. The adjusting bolt 42 pushes up the wedge block 38 through the wedge cover 43 to loosen the movable block 40 and the plate clampers 41, which release the plate.

Figure 12:
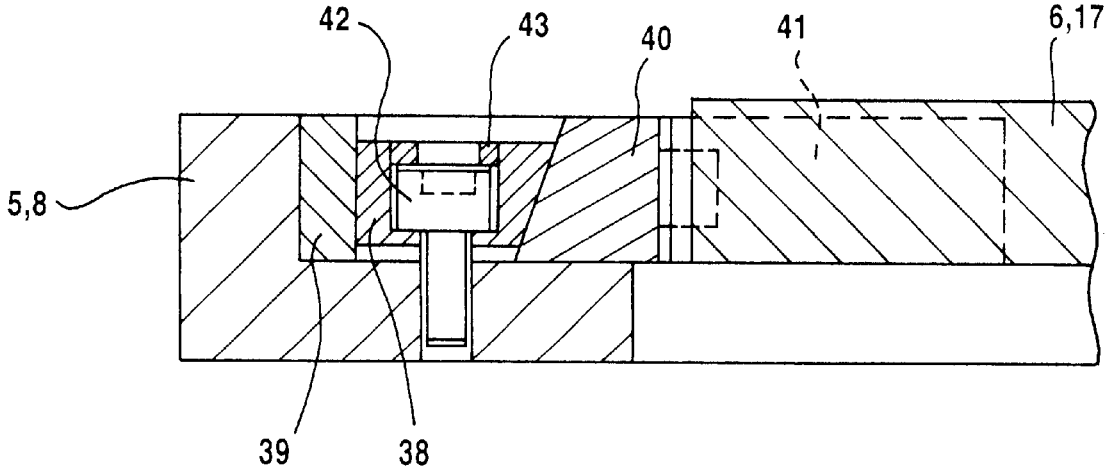
FIG. 12 is a sectional view of another wedge mechanism of the present invention.

In case of the wedge mechanisms for the refractory plates 6 and 17 of FIG. 12, the wedge block 38 of each mechanism has a vertical side facing the stationary block 39 and a slant side facing the movable block 40, but otherwise the mechanisms work in the same way as those in FIG. 11.

The invention may be embodied in other specific forms without departing from the spirit or essential characteristic thereof. The above embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

INDUSTRAIL APPLICABILTY

The advantages offered by the first aspect of the present invention are as follows. The surface pressure between the refractory plates can be effected by utilizing the cylinder for moving the slidable refractory plate. The cylinder rod pushes the surface-pressure bars so that the bars, of which the front end portions are cut slant on their bottom sides, ride on the rollers which are supported by the roller arms of the spring cases. Accordingly, the coil springs in the spring cases push up the surface-pressure bars to effect the surface pressure between the refractory plates. Then, the surface pressure can be lifted by utilizing the same cylinder. The surface-pressure bars can be pulled back by contracting the cylinder. While the rollers are on the horizontal bottom surfaces of the surface-pressure bars, the bars are under the rolling resistance of the rollers, which however is very small. When the rollers come on the slant bottom surfaces of the front end portions of the bars, the coil springs and the rollers act to push back the bars. Thus, the cylinder for moving the slidable refractory plate can, as it is without raising its driving force or otherwise improving it, be utilized to effect and lift the surface pressure between the refractory plates.

On the other hand, because the slide block is guided by guide grooves and the slide block is connected with the cylinder so that there occur relative slips between them, eccentric bending moment caused by the effecting and the lifting of the surface pressure is not transmitted to the cylinder rod.

Besides, the front end portions of the surface-pressure bars ride on the rollers until their slant bottom surfaces goes beyond the rollers and their horizontal bottom surfaces comes on the rollers. Accordingly, the surface pressure between the refractory plates is always effected at one and the same level. Moreover, the surface pressure can be lifted by setting the release jig between the block with a T-shaped groove of the connecting member and the protrusions of the slide block and contracting the cylinder. Then, the surface pressure can be effected by removing the release jig and extending the cylinder which pushes the surface-pressure bars through the media of said protrusions, said block, and the connecting bar. Accordingly, the surface pressure can be effected and lifted without fail.

The advantage offered by the second aspect of the present invention is that the refractory plates can easily be installed and removed just by turning the adjusting bolts.

What is claimed is:

1. A slide gate comprising a frame fixed to a bottom of a molten-steel vessel, a guide frame attached to a bottom of the frame so as to be openable and closeable, and an upper refractory plate and a lower refractory plate, both refractory plates disposed in a space surrounded by the frame and the guide frame, the lower refractory plate being slidable to control an opening degree of a nozzle gate, wherein:

the frame has, on each side, a spring receiver extending in a sliding direction of said lower slidable refractory plate;

a spring case, in which coil springs are set, is mounted on each spring receiver;

each spring case has, at each end, a pair of roller arms which extend to below the spring receiver and support a roller;

a pair of surface-pressure bars are provided such that, when said guide frame is closed, each surface-pressure bar takes a position facing a spring case across the spring receiver and is movable under guidance by the guide frame;

the frame and the guide frame are coupled together and the lower slidable refractory plate is pressed to the upper refractory plate by the coil springs to effect surface pressure between them by pressing a protrusion provided on a slide block against a connecting member of the pair of surface-pressure bars and extending a cylinder for sliding the lower slidable refractory plate to engage the surface-pressure bars with the rollers; and a release jig is set between and connects the protrusion of the slide block and the connecting member of the surface-pressure bars and the cylinder is contracted to disengage the surface-pressure bars from the rollers and, thereby, lift said surface pressure.

2. A slide gate as claimed in claim 1 wherein each refractory plate is mounted and removed by using a wedge mechanism with a tapered member and a bolt and turning the bolt.

* * * * *